US005498517A

United States Patent [19]

Verbeeck et al.

[11] Patent Number: 5,498,517

[45] Date of Patent: Mar. 12, 1996

[54] PROCESS FOR THE PREPARATION OF A HYBRID DIRECT POSITIVE EMULSION AND PHOTOGRAPHIC MATERIAL CONTAINING SUCH AN EMULSION

[75] Inventors: Ann Verbeeck, Begijnendijk; Kris Viaene, Bonheiden, both of Belgium

[73] Assignee: Agfa-Gevaert, N.V., Mortsel, Belgium

[21] Appl. No.: 315,449

[22] Filed: Sep. 30, 1994

[30] Foreign Application Priority Data

Oct. 15, 1993 [EP] European Pat. Off. ..... 93202899

[51] Int. Cl.[6] ..... G03C 1/015; G03C 1/005; G03C 1/035

[52] U.S. Cl. ..... 430/569; 430/567

[58] Field of Search ..... 430/567, 569

[56] References Cited

U.S. PATENT DOCUMENTS

| | | | |
|---|---|---|---|
| 4,063,951 | 12/1977 | Bogg | 430/569 |
| 4,142,900 | 3/1979 | Maskasky | 430/567 |
| 5,418,124 | 5/1995 | Suga et al. | 430/567 |
| 5,426,023 | 6/1995 | Uchida | 430/567 |

FOREIGN PATENT DOCUMENTS

| | | | |
|---|---|---|---|
| 0561415 | 9/1993 | European Pat. Off. | 430/569 |

OTHER PUBLICATIONS

"Science and Technology of Photgraphy", K. Keller, ed.; VCH, 1994, Weinheim FRG, p. 53.

*Primary Examiner*—Charles L. Bowers, Jr.
*Assistant Examiner*—Mark F. Huff
*Attorney, Agent, or Firm*—Breiner & Breiner

[57] ABSTRACT

A process is disclosed for the preparation of a hybrid direct positive silver halide emulsion comprising the steps of (1) forming an essentially cubic host grain emulsion consisting of silver bromide or silver iodobromide, with a iodide content between 0 and 10 mole %, by a balanced double jet, (2) depositing epitaxially on the corners of said formed essentially cubic host grains a silver iodide crystallographic phase wherein said silver iodide phase contains at most 5 % of the total crystal silver halide, either by precipitating a silver chloride epitaxial phase and converting it to silver iodide, or by adding silver ions and an organic iodide releaser.

The organic iodide releaser is preferably mono-iodoacetic acid.

6 Claims, No Drawings

PROCESS FOR THE PREPARATION OF A HYBRID DIRECT POSITIVE EMULSION AND PHOTOGRAPHIC MATERIAL CONTAINING SUCH AN EMULSION

DESCRIPTION

1. Field of the Invention

The present invention relates to a process for the preparation of a new type of direct positive photographic emulsion and to a photographic material containing such an emulsion.

2. Background of the Invention

Hybrid silver halide emulsions comprising a first crystal phase, usually called "host grain", and a second crystal phase of different halide composition epitaxially deposited on selected sites of the host grain are known for quite some time in the art of photographic emulsion making. For instance, epitaxial deposition of a silver chloride or bromide phase on silver iodide host grains was described by Maskasky in U.S. Pat. Nos. 4,094,684, 4,124,900 and 4,158,565. U.S. Pat. No. 4,496,652 discloses negative or direct positive tetradecahedral emulsions on whose (111) faces a second phase is deposited by a second double jet of silver and halide salts. Further teachings on host grains rich in iodide to which another halide phase is epitaxially junctered include JP-B-88/043733 and JP-B-88/042768 (JP-B- meaning Examined Japanese Patent Publication) and EP 0 019 917. Internal latent image type silver halide particles to wich a surface sensitive epitaxial phase is adjoined are disclosed in JP-B-88/43734. A photothermographic material containing an epitaxial emulsion is described in JP-A-58-046339 (JP-A- meaning Unexamined Japanes Patent Publication). Tabular grains having epitaxial deposition are for the first time disclosed by Maskasky in U.S. Pat. Nos. 4,435,501. Maskasky 4,463,087 reveals silver halide grains predominantly bounded by (111) crystal faces to which a so-called "site director" is adsorbed before the epitaxial deposition takes place. Further Maskasky disclosures include U.S. Pat. Nos. 4,459,353 and 4,471,050. Other additions and improvements on the teachings on epitaxial emulsions can be found a.o. in U.S. Pat. No. 4,735,894, JP-A-61-088252, JP-A-61-279848, U.S. Pat. No. 4,888,272, JP-A-63-264739, JP-A-63-274943, JP-A-63-316048, JP-A-01-077045, JP-A-01-113745, JP-A-01-179140, JP-A-01-213638, JP-A-01-205151 and JP-A-01-213636.

Almost all of the teachings on epitaxial emulsions deal with negative working emulsions or with crystallographic aspects only. As far as we are aware, only U.S. Pat. No. 4,496,652, cited above, discloses either a chemically ripened negative host grain emulsion or an externally fogged direct positive host grain emulsion.

With externally fogged direct positive emulsions it is not easy to reach the high sensitivity level which can be obtained with internal latent image type direct positive emulsions, which are developed by fogging development, e.g. by using hydrazines. Probably this is due at least partially to the heterogeneous character of the external chemical fogging. However direct positive emulsions show the advantage of not requiring a rather unecological processing as it is the case when fogging developers are used. So there is a permanent need for externally fogged direct positive emulsions with improved sensitivity and improved other sensitometric properties, e.g. exposure latitude in case of recording purposes.

The present invention is an extension of the teachings of U.S. Pat. No. 4,496,652 as far as direct positive emulsions are concerned.

It is an object of the present invention to provide a process for the preparation of an externally fogged direct positive emulsion with improved sensitivity and exposure latitude.

It is a further object of the present invention to provide a photographic material containing such an improved direct positive emulsion.

SUMMARY OF THE INVENTION

The objects of the present invention are realized by providing a process for the preparation of a hybrid direct positive silver halide emulsion comprising the following steps:

(1) forming an essentially cubic host grain emulsion consisting of silver bromide or silver iodobromide, with a iodide content between 0 and 10 mole %, by a balanced double jet precipitation of a silver ion and a halide ion solution at a pAg between 7 and 9;

(2) depositing epitaxially on the corners of said formed essentially cubic host grains a silver iodide crystallographic phase wherein said silver iodide phase contains at most 5% of the total crystal silver, either by, (2.1) performing a second balanced double jet precipitation of an organic silver ion and chloride ion solutions at a pAg between 7 and 9, and then adding an amount of iodide ions at least equivalent to the chloride ions, in this way converting the formed epitaxial silver chloride phase into an epitaxial silver iodide phase; or, (2.2) adding a silver ion solution and an organic iodide releasing compound represented by formula (R) to the emulsion grains formed according to step (1);

$$A\text{–}L\text{–}I \qquad (R)$$

wherein A represents a group with a positive $\sigma_p$ value, and L is a divalent linking group;

(3) externally fogging the obtained hybrid emulsion crystals;

(4) adding an electron-accepting spectral dye which adsorbs to the fogged surface of said hybrid emulsion crystals.

Unexpectedly direct positive emulsions with higher sensitivity and extended exposure latitude were obtained.

DETAILED DESCRIPTION OF THE INVENTION

The choice of the pAg range for the precipitation—between 7 and 9—of the host grains is such that an essentially cubic emulsion grain is obtained. By essentially cubic is meant a grain which either is (a) perfectly cubic, or (b) cubic with rounded corners, or (c) cubic with small (111) faces on the corners so that in fact a tetradecahedrical emulsion is obtained, the total area of these (111) faces however being small compared to the total area of the (100) faces.

The precipitation in connection with the present invention forming the silver bromide or silver iodobromide host emulsion can be principally performed by one double jet step; alternatively it can consist of a sequence of a nucleation step and at least one growth step. In the latter case, of the total silver precipitated preferably 0.5% to 5.0% is added during said nucleation step which consists preferably of an approximately equimolecular addition of silver and halide salts. The rest of the silver and halide salts is then added during one or more consecutive double jet growth steps. The different steps of the precipitation can be alternated by physical ripening steps. During the growth step(s) the flow rate of the silver salt and halide solutions can be kept constant; alternatively an increasing flow rate of silver salt and halide ion solutions can be established, e.g. a linearly increasing flow rate. Typically the flow rate at the end is about 3 to 5 times greater then at the start of the growth step. These flow rates can be monitored by e.g. magnetic valves.

However in a preferred embodiment of the present invention the essentially cubic host emulsion is formed simply by one double jet step at a pAg maintained at a constant value between 7 and 9 without separate nucleation step and at a constant flow rate. The constant pAg is realized by the use of a so-called "bypass solution" the addition of which is alternatingly switched on and off. The concentrations of the main silver salt and halide solutions typically range between 0.5 and 3 molar, and most preferably between 1 and 2 molar.

In one embodiment of the present invention the host emulsion is freed from excess of soluble inorganic salts by a conventional wash technique, e.g. flocculation by ammonium sulphate or polystyrene sulphonate, followed by several washing steps and redispersion. Another well-known wash technique is ultrafiltration. Finally extra gelatin can be added to the emulsion in order to obtain the desired gelatin/silver ratio. In another embodiment of the present invention the epitaxial deposition of silver iodide, to be described in detail hereafter, is performed immediately after the grain formation of the host emulsion, and subsequently the washing procedure, redispersion if needed and adjustment of the final gelatin / silver halide ratio are performed.

In the prior art teachings on epitaxial emulsion the epitaxial phase is usually grown by a second balanced double jet of silver salt and halide ions. However it was established experimentally by us that if one tries to deposit a silver iodide phase on an essentially cubic host emulsion by a direct double jet of silver salt and iodide ions unreproducible and worthless results are obtained due to aspecific conversion and secondary nucleation phenomena. It is the merit of the present invention to have overcome this problem by either, in a first embodiment, epitaxially depositing a silver chloride phase and then converting it quantitatively to a silver iodide phase, or, in a second embodiment, by performing the silver iodide epitaxial growth with the aid of an organic iodide releasing compound.

In the first embodiment the temporary deposition of the silver chloride is achieved by a balanced double jet precipitation of silver salt and chloride ion solutions at a pAg between 7 and 9 at a temperature preferably between 40° and 70° C. Preferably equimolecular amounts of silver ions and chloride ions are added preferably at a constant flow rate. Then a dilute solution of iodide ions, e.g. potassium ions, is added to the reaction vessel in an amount at least equimolar, and preferably exact equimolar to the silver chloride amount, and the mixture is allowed to digest for at least 5 minutes. The concentration of the iodide solution is preferably comprised between 0.5 and 3 molar. Due to the great difference in solubility product the epitaxial silver chloride phase is quantitatively converted to a silver iodide phase without the occurence of aspecific conversion on unwanted sites of the emulsion grain.

In a second embodiment of the present invention the epitaxial deposition of silver iodide is realized by the addition of a silver salt solution and a solution of an organic iodide releasing compound. Preferably the two solutions are added simultaneouly and in equimolar amounts. Due to the slow release of iodide from the organic releaser the pAg is first lowered but increases again lateron. After completion of the addition the reaction mixture is stirred for at least 15 minutes, before it is allowed to cool. The epitaxial deposition of silver iodide can be confirmed by well-known analytical techniques such as X-ray fluorescence and X-ray diffraction.

The use of organic halide releasing compounds is not new in the photographic art. In Zh. Nauch. Prikl. Fot. Kine 35, 142, (191), Poloznikov and Shapiro describe new forms of silver bromide microcrystals as a result of the interaction of silver nitrate and bromoacetic acid. JP-A-02-68538 describes the use of organic chloride, bromide and iodide slow releasers to avoid microscopic heterogeneities inherently associated with non-homogeneous concentrations of silver ions and halide ions in the conventional circumstances of nucleation and growth. Examples of such heterogeneities include heterogeneous particle size, crystal irregularities and heterogeneous halide distribution between and within particles. Further extensions of this teaching can be found in EP 0 341 728 and EP 0 531 799.

The iodide ion releasers for use in the present invention are represented by the following general (R):

$$A—L—I \qquad (R)$$

wherein A represents a group with a positive Hammett $\sigma_p$ value, and L is a divalent linking group.

A group with a positive Hammett $\sigma_p$ value (A) is commonly known as an electron-accepting or electon-withdrawing group. Hammett $\sigma_p$ values have been defined e.g. on p. 96 of "Structure/Activity Correlations for Drugs" published by Nankodo (1979). Most preferred A groups include a carboxylic acid group, a cyano group, a carbamoyl group, an acyl group, a sulphonyl group, an oxycarbonyl group, a sulphamoyl group.

The organic iodide releasing compounds are preferably corresponding to the above formula wherein the divalent linking group is chosen from unsubstituted or substituted alkylene, unsubstituted or substituted oxyalkylene, unsubstituted or substituted aralkylene, or combinations of two or more thereof, wherein several atoms of L, or of A and L, can combine to form a ring, and wherein the iodine atom is not bound to an aromatic moiety or to an atom bearing a double bond, or to a hetero-atom.

Useful examples of such iodide ion slow releasers include following compounds:

$ICH_2COOH$ (R-1)

$I(CH_2)_2COOH$ (R-2)

$I(CH_2)_3COOH$ (R-3)

$CH_3CHICOOH$ (R-4)

$CH_3CH_2CHICOOH$ (R-5)

$CH_2CHICH_2COOH$ (R-6)

$HOOC-CHI-COOH$ (R-7)

$HOOC-CH_2-CHI-COOH$ (R-8)

$ICH_2CN$ (R-9)

$I(CH_2)_2CONH_2$ (R-10)

-continued $ICH_2COCH_3$ (R-11)

$I(CH_2)_2SO_2CH_3$ (R-12)

$ICH_2COOCH_3$ (R-13)

$ICH_2CH_2SO_3Na$ (R-14)

$ICH_2CONH_2$ (R-15)

$ICH_2-CO-NH-C(CH_2OH)_3$ (R-16)

$ICH_2-CO-NH-C_2H_4-SO_3Na$ (R-17)

$ICH_2-CO-NH-CH_2-(CHOH)_4-CH_2OH$ (R-18)

(R-19)

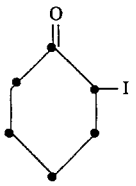

(R-20)

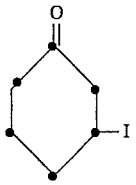

(R-21)

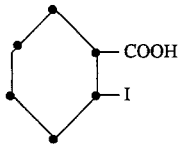

(R-22)

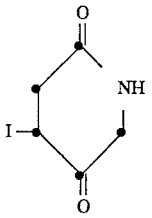

In a particular preferred embodiment the iodide ion slow releaser is simply mono-iodoacetic acid (R-1).

The iodide releaser is preferably used in aqueous solution in a concentration between 0.1 and 1 molar.

In both embodiments of applying the epitaxial silver iodide phase the amounts of reagents necessary for the deposition of that phase are chosen in such a way that the epitaxial phase comprises at most 5 mole % of the total crystal silver halide.

At an appropriate time the prepared hybrid silver halide emulsion is melted again and surface fogged in order to obtain a direct positive working emulsion. External fogging can be accomplished according to the teachings of U.S. Pat. Nos. 3,367,77.8, 3,501,305, 3,501,306, 3,501,307 and 3,637,392. In a preferred embodiment the fogging is performed by the combined use of a reductor and a noble metal salt. In a most preferred embodiment of the practice of the present invention the fogging is accomplished by using a combination of thioureadioxide and gold(III) chloride. The fogging is continued with periodical monitoring until the desired maximum density/sensitivity relationship is reached and then terminated by cooling.

In the final stage of the preparation of an externally fogged direct positive emulsion an electron-accepting spectral dye is added and adsorbed to the emulsion grains. Dyes which desensitize negative working emulsions are usually suitable as electron-accepting spectral sensitizers for fogged direct positive emulsions. Typical heterocyclic nuclei featured in cyanine and merocyanine dyes well-suited for this purpose are derived from nitrobenzothiazol, 2-aryl-1-alkylindole, pyrrolo[2,3-b]pyridine, imidazo[4,5-b]quinoxaline, carbazole, pyrazol, 5-nitro-3H-indole, 2-arylbenzindole, 2-aryl-1,8-trimethyleneindole, 2-heterocyclylindole, pyrylium, benzopyrylium, thiapyrylium, 2-amino-4-aryl-5-thiazole, 2-pyrrole, 2-(nitroaryl)indole, imidazo[1,2-a]pyridine, imidazo[2, 1-b]thiazole, imidazo[2,1-b]-1,3,4-thiadiazole, imidazo[1,2,-b]pyridazine, imidazo[4,5-b]quinoxaline, pyrrolo [2,3-b]quinoxaline, pyrrolo[2,3-b]pyrazine, 1,1-diarylindole, 1-cyclohexylpyrrole and nitrobenzoselenazole. Such nuclei can further be enhanced as desensitizers by electron-withdrawing groups such as nitro, acetyl, benzoyl, sulphonyl, benzosulphonyl and cyano groups.

Specific examples of useful electron-accepting spectral dyes will be mentioned in the examples lateron.

To the thus finished direct positive emulsion can be added conventional useful photographic ingredients and coating aids and the thus prepared coating solution can be applied to a support giving rise to a direct positive photographic material by any of the known coating techniques, e.g. air knife, slide hopper and curtain coating. It is specifically contemplated that such a photographic material containing a hybrid direct positive emulsion prepared by the process described above forms part of the scope of the present invention.

The use of such a direct positive photograhic material of the present invention is not limited to any particular field or application. However it will be clear that the full benifit of the present invention will become most perspicuous in those applications were a high sensitivity is required, e.g. recording purposes.

The emulsion layer of the photographic element according to the invention can be simply just one single layer or it can be splitted into a double layer or even into a multilayer pack. Beside the light-sensitive emulsion layer(s) the photographic material can contain several non-light-sensitive layers, e.g. a protective top layer, one or more backing layers, and one or more intermediate layers.

Besides the silver halide another essential component of a light-sensitive emulsion layer is the binder. The binder is a hydrophilic colloid, preferably gelatin. Gelatin can, however, be replaced in part or integrally by synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. other proteins such as zein, albumin and casein, cellulose, saccharides, starch, and alginates. In general, the semi-synthetic substitutes for gelatin are modified natural products e.g. gelatin derivatives obtained by conversion of gelatin with alkylating or acylating agents or by grafting of polymerizable monomers on gelatin, and cellulose derivatives such as hydroxyalkyl cellulose, carboxymethyl cellulose, phthaloyl cellulose, and cellulose sulphates.

The binders of the photographic element, especially when the binder used is gelatin, can be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts as disclosed in U.S. Pat. No. 4,063,952.

The silver halide emulsion layer(s) may further comprise compounds preventing the formation of fog or stabilizing the photographic characteristics during the production or storage of photographic elements or during the photographic treatment thereof. Many known compounds can be added as fog-inhibiting agent or stabilizer to the silver halide emulsion. Suitable examples are e.g. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB 1,203,757, GB 1,209,146, JA-Appl. 75-39537, and GB 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide. Other compounds that can be used as fog-inhibiting compounds are metal salts such as e.g. mercury or cadmium salts and the compounds described in Research Disclosure N° 17643 (1978), Chapter VI.

The photographic material of the present invention may further comprise various kinds of surface-active agents in the photographic emulsion layer or in another hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion.

The photographic elements according to the present invention may further comprise various other additives such as e.g. compounds improving the dimensional stability of the photographic element, UV-absorbers, spacing agents and plasticizers.

Suitable additives for improving the dimensional stability of the photographic elements are e.g. dispersions of a water-soluble or hardly soluble synthetic polymer e.g. polymers of alkyl(meth)acrylates, alkoxy(meth) acrylates, glycidyl (meth)acrylates, (meth)acrylamides, vinyl esters, acrylonitriles, olefins, and styrenes, or copolymers of the above with acrylic acids, methacrylic acids, Alpha-Beta-unsaturated dicarboxylic acids, hydroxyalkyl (meth)acrylates, sulphoalkyl (meth)acrylates, and styrene sulphonic acids.

Spacing agents can be present, preferably in the top protective layer; in general the average particle size of such spacing agents is comprised between 0.2 and 10 micron. They can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made e.g. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

The support of the photographic materials in connection with the present invention can be transparent base, preferably an organic. resin support, e.g. cellulose nitrate film, cellulose acetate film, polyvinylacetal film, polystyrene film, polyethylene terephthalate film, polycarbonate film, polyvinylchloride film or poly-Alpha-olefin films such as polyethylene or polypropylene film. The thickness of such organic resin film is preferably comprised between 0.07 and 0.35 mm. These organic resin supports are preferably coated with a subbing layer. On the other hand the support of the photographic material can be a paper base preferably a polyethylene or polypropylene coated paper base.

The photographic materials according to the invention have to be exposed by a convenient light source according to their application. They can be processed by any means or any chemicals known in the art depending on their composition and particular application. For producing a black-and-white image they are preferably processed in a conventional Phenidone/hydroquinone or substituted Phenidone/hydroquinone developing solution and a conventional sodium or ammonium thiosulphate containing fixing solution. The development time is usually between 10 and 30 seconds at a temperature of about 35 ° C.

The following examples illustrate the present invention without however limiting it thereto.

EXAMPLES

EXAMPLE 1

Preparation of control emulsion C-1

The following solutions were prepared:

a dispersion medium (C) in a reaction vessel containing 1500 ml of demineralized water, 50 g of inert gelatin and 15 g of methionine;

2000 ml of a 1.47 molar silver nitrate solution (A);

2165 ml of a solution 1.3 molar in potassium bromide and 0.0135 molar in potassium iodide (B1);

216,5 ml of the same latter solution (B2; "bypass" solution).

Solutions (A) and (B1) were added during 31 minutes at 57 ° C. in a balanced double jet to the reaction vessel containing dispersion medium (C) in such a way that, by means of interrupted addition of bypass solution (B2), the silver potential, measured by a silver electrode versus a saturated calomel electrode (SCE), was maintained at a constant value of +20 mV, corresponding to a pAg of 8.3.

The precipitated emulsion was physically ripened at 57° C. during 23 minutes. Then the pH was adjusted to 3.5 with sulphuric acid and the emulsion was flocculated by the addition of sufficient low-molecular weight polystyrene sulphonate solution. The flocculated emulsion was washed thoroughly for several times with water. Finally the emulsion was redispersed and gelatin and water were added to obtain a final emulsion of about 3.2 kg, having a gelatin/silver ratio (gesi), the latter expressed as silver nitrate, of 0.6, and an average grain size of 0.24 μm. The crystal morphology was essentially cubic as confirmed by electron microscopy.

This control emulsion was set aside to serve as future host emulsion for the epitaxial depositions described hereafter.

preparation of invention emulsion I-1

7 kg of the cubic host emulsion described above, containing 165,7 g of Ag/kg, were melted at 40° C. The pH was adjusted to 7.5 and the pAg to a value corresponding to +100 mV. Then an epitaxial deposition of a silver chloride phase was effected on the corners of the cubic grains by the simultaneous addition over a period of 70 seconds of 49.8 ml of a 2.94 molar solution of silver nitrate and 49.8 ml a 2.94 molar solution of sodium chloride.

Then 580 ml of a 0.294 molar solution of potassium iodide was added over a period of 70 seconds and the mixture was stirred for 30 minutes. Due to the much lower solubility product of silver iodide compared to silver chloride the epitaxial silver chloride phase was completely converted to a silver iodide epitaxial phase (as was confirmed by X-ray fluorescence and X-ray diffraction.

preparation of invention emulsion I-2

980 g of a similar cubic host emulsion containing 169.2 g of Ag/kg was melted at 40 ° C. and the pH was adjusted to 7.5 and the pAg was adjusted to a value corresponding to +100 mV. In a period of 100 seconds 49.8 ml of a 0.3 molar silver nitrate solution and 49.8 ml of a 0.3 molar mono-iodoacetic acid solution were added, and the reaction mixture was stirred for another 30 minutes and then allowed to cool. In this way a silver iodide epitaxial phase was applied to the corners of the original basic grains as was confirmed by X-ray fluorescence and X-ray diffraction.

preparation of control emulsion C-2

This control emulsion was identical to emulsion I-1 with the exception that no final iodide conversion was performed. So a silver chloride epitaxial phase remained on the corners of the emulsion crystal.

further treatment and photographic evaluation

The four emulsions described above were externally fogged at 55° C., pH 7.5 and +100 mV using a 0.005 % thioureadioxide solution (fogging solution A) and a 0.06% gold(III) trichloride solution (fogging solution B) in amounts given in table 1. The fogging was terminated by cooling when an optimal maximum density—sensitivity relationship was reached. Then four different coating solutions were prepared each containing one of the fogged emulsions and 51 mg/100 g Ag of an electron-accepting spectral dye, actif in the red spectral region, and corresponding to following formula EA-1:

(EA-1)

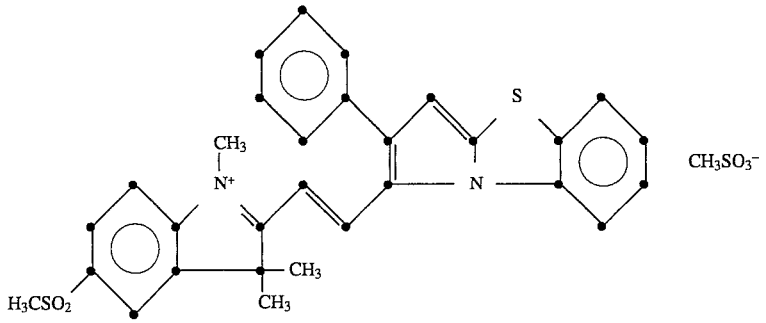

Further to the coating solution were added suitable amounts of the stabilizer 5-nitrobenzimidazol and various coating aid solutions. These photosensitive coating solutions were applied at a silver coverage of 2.5 g/m$^2$, expressed as $AgNO_3$, on top of a transparent support and an "undercoat" layer, the latter having a gelatin coverage of 1.2 g/m$^2$ and containing a conventional anti-halation dye. On top of each coated photosensitive layer a protective layer was applied.

The four samples were exposed to flash (??) light through a continuous tone wedge and developed in a conventional hydroquinone/methyl-Phenidone developer for 14 seconds at 30 ° C. They were fixed in a conventional fixer, rinsed with water and dried. The sensitometric results are represented in table 1. The sensitivity (S) was measured at density 0.2 + Dmin and expressed as relative log H, higher figure meaning higher sensitivity.

TABLE 1

| | fogging sol. | | | dir. pos. sensitometry | | | |
|---|---|---|---|---|---|---|---|
| emulsion | A | B (/50 g Ag) | fogging time | Dmin | S | gradation | Dmax |
| C-1 | 1 ml | 0.5 ml | 4.00 h | 0.11 | 69 | 3.27 | 2.38 |
| I-1 | 0.5 ml | 0.25 ml | 3.00 h | 0.40 | 82 | 1.03 | 2.05 |
| I-2 | " | " | 2.50 h | 0.15 | 95 | 2.23 | 2.20 |
| C-2 | 1 ml | 0.5 ml | | no dir. Pos. sensitometry | | | |

The results of table 1 illustrate several advantages of the invention emulsions. The fogging time is reduced, even using lower amounts of fogging agents, the sensitivity is increased, and, as can be seen from the lower gradation and the only slightly lower maximum density, the exposure latitude is increased. Especially the results with emulsion I-2 are favourable.

EXAMPLE 2

In this test series preparation of some of the emulsions of the previous example was repeated and extended to new emulsions with various other percentages of the epitaxial siver iodide phase. The series included following emulsions:

C-3: preparation identical to C-1;

I-3: similar to I-2 (use of mono-iodoacetic acid) but the silver iodide phase comprises only 1% of the total silver halide;

I-4: identical to I-2 (use of iodoacetic acid, and the silver iodide phase comprise 2.5% of the total silver halide);

I-5: identical to I-1 (iodide conversion of a AgCl phase, the silver iodide phase comprises 2.5% of total silver halide);

I-6: similar to I-5, but the silver iodide phase comprises 5% of the total silver halide.

The emulsions were fogged in a similar way as in example 1. Then an electron-accepting spectral dye, actif in the green+spectral region, and corresponding to following formula EA-2 was added (instead of compound EA-1 of ex. 1):

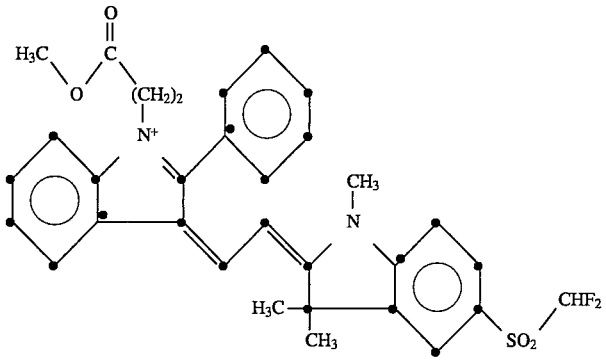

(EA-2)

I⁻

Furtheron conventional coating aids were added and the various coating solutions were applied on a transparent support at a silver coverage of ? g/m$^2$. The samples were exposed with tungsten light through a continuous tone wedge and developed in a conventional methyl-Phenidone/hydroquinone developer, fixed, rinsed and dried. The direct positive sensitometric results are summarized in table 2.

TABLE 2

| | conc. fogging agent | | dir. pos. sensitometry | | |
|---|---|---|---|---|---|
| emulsion | A | B (/50 g Ag) | Dmin | S | Dmax |
| C-3 | 1 ml | 0.5 ml | 0.030 | 0.89 | 2.25 |
| I-3 | 0.5 ml | 0.25 ml | 0.004 | 1.00 | 3.15 |
| I-4 | " | " | 0.004 | 1.13 | 3.67 |
| I-5 | " | " | 0.010 | 1.62 | 2.57 |
| " | 0.25 ml | 0.125 ml | 0.003 | 1.23 | 2.70 |
| I-6 | " | " | 0.085 | 0.95 | 2.10 |

Table 2 again illustrates the better sensitometic properties, especially sensitivity, of the invention emulsions.

We claim:

1. Process for the preparation of a direct positive silver halide emulsion comprising the following steps:

(1) forming an essentially cubic host grain emulsion consisting of silver bromide and silver iodobromide, with a iodide content between 0 and 10 mole %, by a balanced double jet precipitation of silver ion and halide ion solutions at a pAg between 7 and 9;

(2) depositing epitaxially on the corners of said formed essentially cubic host grains a silver iodide crystallographic phase wherein said silver iodide contains at most 5% of the total crystal silver halide, either by, (2.1) performing a second balanced double jet precipitation of a silver ion solution and a chloride ion solution at a pAg between 7 and 9, and then adding an amount of iodide ions at least equimolar to said chloride ions, in this way converting the formed epitaxial silver chloride phase into an epitaxial silver iodide phase;

or, (2.2) adding a silver ion solution and a solution of an organic iodide releasing compound represented by formula (R) to said essentially cubic host grain emulsion formed according to step (1);

A—L—I (R)

wherein A represents a group with a positive Hammett $\sigma_p$ value, and L is a divalent linking group;

(3) externally fogging said emulsion crystals;

(4) adding an electron-accepting dye which adsorbs to said fogged surface of said emulsion crystals.

2. Process according to claim 1 wherein said group A present in general formula (R) of said organic iodide releasing compound is chosen from the group consisting of a carboxylic acid group, a cyano group, a carbamoyl group, an acyl group, a sulphonyl group, an oxycarbonyl group, a sulphamoyl group.

3. Process according to claim 1 wherein said divalent linking group is chosen from the group consisting of alkylene, oxyalkylene, aralkylene, or combinations of two or more thereof, wherein several atoms of L, or of A and L, can combine to form a ring, and wherein the iodine atom is not bound to an aromatic moiety or to an atom bearing a double bond or to a hetero-atom.

4. Process according to claim 1 wherein said organic iodide releasing compound is mono-iodoacetic acid.

5. Direct positive photographic material comprising a support and at least one emulsion layer containing a direct positive silver halide emulsion prepared according to the process of claim 1.

6. Direct positive photographic material according to claim 5 wherein said material is a recording material.

* * * * *